US006050796A

United States Patent [19]

Wong et al.

[11] Patent Number: 6,050,796

[45] Date of Patent: Apr. 18, 2000

[54] VANE PUMP

[75] Inventors: Albert Cheuk-Yin Wong; Tom Cheuk-In Wong, both of Saginaw, Mich.

[73] Assignee: General Motors Corporation, Detroit, Mich.

[21] Appl. No.: 09/080,496

[22] Filed: May 18, 1998

[51] Int. Cl.[7] ..... F01C 19/08

[52] U.S. Cl. ..... 418/132; 418/133

[58] Field of Search ..... 418/131, 132, 418/133, 268

[56] References Cited

U.S. PATENT DOCUMENTS

| | | | |
|---|---|---|---|
| 360,565 | 4/1887 | Dawson . | |
| 621,193 | 3/1899 | Wilson . | |
| 1,635,523 | 1/1927 | Wilson . | |
| 2,283,033 | 5/1942 | Beach | 230/153 |
| 2,447,961 | 8/1948 | Rodway | 230/152 |
| 3,207,077 | 9/1965 | Zeigler et al. | 103/42 |
| 3,523,746 | 8/1970 | Dadian et al. | 418/132 X |
| 3,834,846 | 9/1974 | Linder et al. | 418/255 |
| 3,973,881 | 8/1976 | Melchinger | 418/81 |
| 4,386,891 | 6/1983 | Riefel et al. | 418/81 |
| 4,416,598 | 11/1983 | Merz | 418/132 |
| 4,795,325 | 1/1989 | Kishi et al. | 418/87 |
| 5,266,018 | 11/1993 | Niemiec | 418/132 X |

*Primary Examiner*—Hoang Nguyen
*Attorney, Agent, or Firm*—Edmund P. Anderson

[57] ABSTRACT

A vane pump including a cylindrical rotor rotatable inside of an oval-shaped rotor chamber defined by a cam ring around the rotor. A thrust plate and a pressure plate on opposite sides of the cam ring cover the rotor chamber and are squeezed together by a pressure force attributable to fluid in a discharge chamber of the vane pump at a discharge pressure thereof. Fluid at the discharge pressure of the pump is ported to an annular first longitudinal balance chamber between the pressure plate and an end of the rotor facing the pressure plate and to an annular second longitudinal balance chamber between the thrust plate and an opposite end of the rotor facing the thrust plate. A pressure force on the pressure plate attributable to fluid in the first balance chamber balances a fraction of the pressure force on the pressure plate attributable to fluid in the discharge chamber to reduce flexure of the pressure plate into the rotor chamber. A pressure force on the rotor attributable to fluid in the second balance chamber is equal to the pressure force on the rotor attributable to fluid in the first balance chamber for longitudinal static equilibrium.

5 Claims, 3 Drawing Sheets

VANE PUMP

TECHNICAL FIELD

This invention relates to vane pumps.

BACKGROUND OF THE INVENTION

A vane pump typically includes a cylindrical rotor rotatable inside of an oval-shaped rotor chamber defined by a cam ring around the rotor. The cam ring and the rotor define a crescent-shaped cavity therebetween which is divided into a plurality of pump chambers by a corresponding plurality of flat vanes in radial vane slots in the rotor. The pump chambers expand in an inlet sector of the crescent-shaped cavity and collapse in a discharge sector of the crescent-shaped cavity as the rotor rotates. A thrust plate and a pressure plate on opposite sides of the cam ring cover the rotor chamber and are squeezed together by a plurality of hold-down springs or the like. Fluid in a discharge chamber of the vane pump at a discharge pressure thereof reacts against the pressure plate to further clamp the cam ring between the pressure plate and the thrust plate. A significant fluid pressure differential across the pressure plate within an area defined by the silhouette of the rotor chamber induces flexure of the pressure plate into the rotor chamber. A clearance dimension between the thrust plate, the pressure plate and the rotor calculated to accommodate such flexure exceeds a corresponding clearance dimension calculated only to minimize friction between the thrust plate, the pressure plate and the rotor. Fluid leakage from the pump chambers attributable to the extra clearance for flexure of the pressure plate reduces the volumetric efficiency of the vane pump.

SUMMARY OF THE INVENTION

This invention is a new and improved vane pump including a cylindrical rotor rotatable inside of an oval-shaped rotor chamber defined by a cam ring around the rotor. The cam ring and the rotor define a crescent-shaped cavity therebetween which is divided into a plurality of pump chambers by a corresponding plurality of flat vanes in radial vane slots in the rotor. The pump chambers expand in an inlet sector of the crescent-shaped cavity and collapse in a discharge sector of the crescent-shaped cavity as the rotor rotates. A thrust plate and a pressure plate on opposite sides of the cam ring cover the rotor chamber and are squeezed together by a pressure force attributable to fluid in a discharge chamber of the vane pump at a discharge pressure thereof. Fluid at the discharge pressure of the pump is ported to an annular first longitudinal balance chamber between the pressure plate and an end of the rotor facing the pressure plate and to an annular second longitudinal balance chamber between the thrust plate and an opposite end of the rotor facing the thrust plate. A pressure force on the pressure plate attributable to fluid in the first balance chamber balances a fraction of the pressure force on the pressure plate attributable to fluid in the discharge chamber to reduce flexure of the pressure plate into the rotor chamber. A pressure force on the rotor attributable to fluid in the second balance chamber is equal to the pressure force on the rotor attributable to fluid in the first balance chamber for longitudinal static equilibrium.

DESCRIPTION OF THE PREFERRED EMBODIMENT

Figure 1:
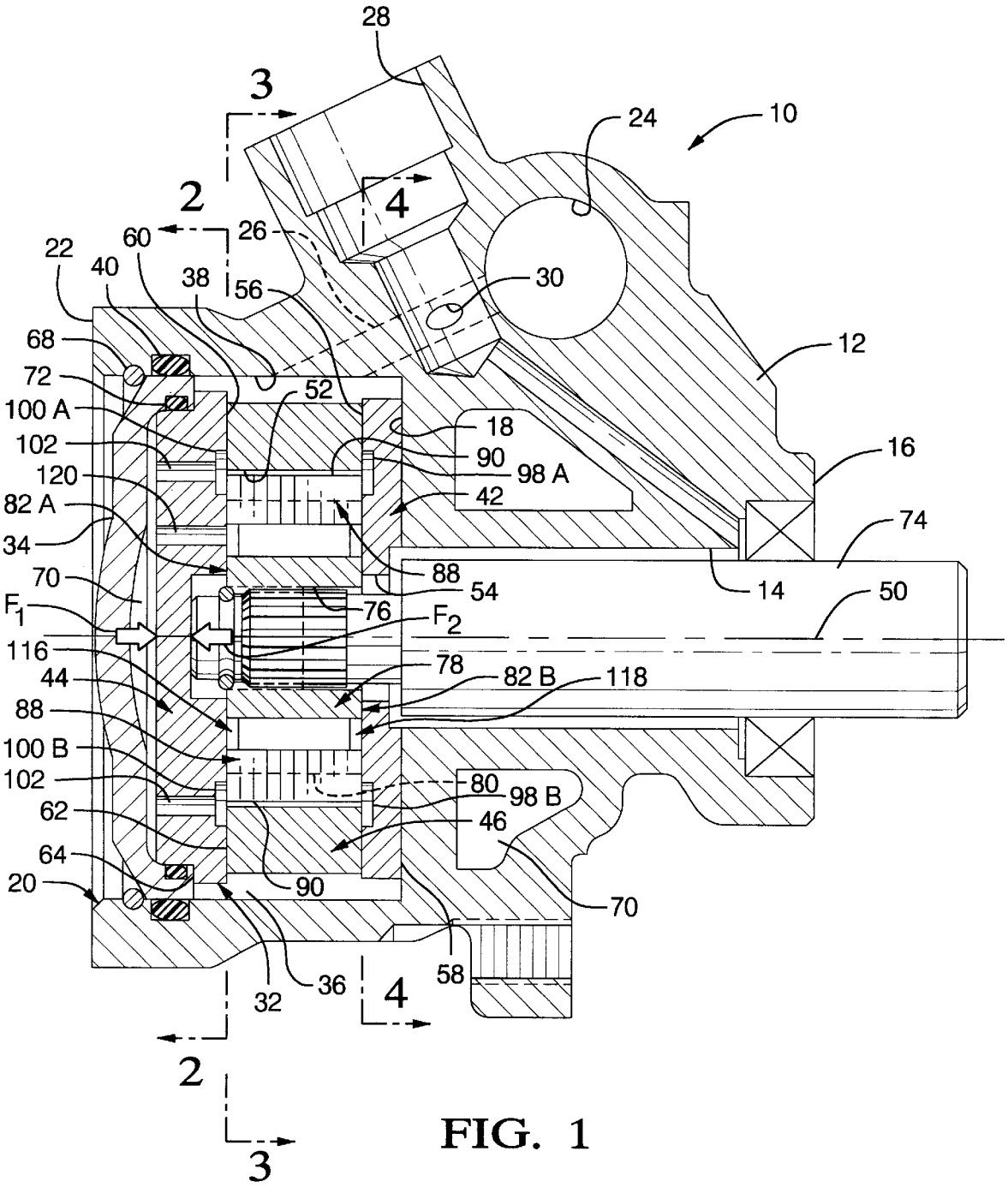
FIG. 1 is a longitudinal sectional view of a vane pump according to this invention.
Figure 2:
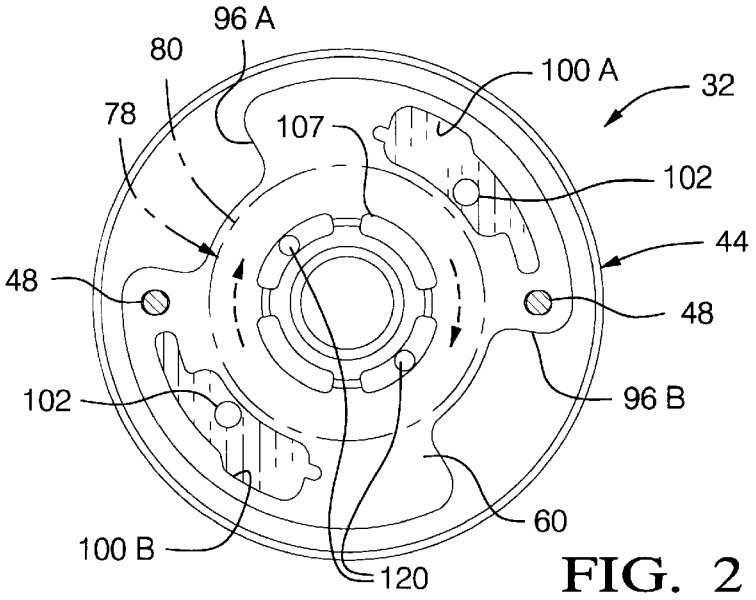
FIG. 2 is a sectional view taken generally along the plane indicated by lines 2—2 in FIG. 1.

Referring to FIGS. 1–4, a vane pump 10 according to this invention includes a housing 12 having therein a drive shaft bore 14 open through a first end 16 of the housing and intersecting a flat bottom 18 of a large counterbore 20 in a second end 22 of the housing. A control valve bore 24 in the housing 12 communicates with the counterbore 20 through a schematically represented internal passage 26 in the housing. An inlet passage 28 in the housing communicates with a reservoir of fluid, not shown, and with the internal passage 26 through an aperture 30.

A "rotating group" 32 of the vane pump 10 is captured in the counterbore 20 between the flat bottom 18 thereof and a disc-shaped cover 34 closing the open end of the counterbore. An annular chamber 36 is defined between a cylindrical side wall 38 of the counterbore 20 and the rotating group. A seal ring 40 suppresses fluid leakage between the housing 12 and the cover 34. The rotating group 32 is stationary relative to the pump housing and includes a thrust plate 42 seated on the flat bottom 18 of the counterbore 20, a pressure plate 44, and a cam ring 46 between the thrust plate and the pressure plate. A plurality of dowel pins 48 traverse the pressure plate, the thrust plate, the cam ring and the housing and prevent relative rotation therebetween about a longitudinal centerline 50 of the vane pump.

The cam ring 46 has a oval-shaped wall 52 facing the longitudinal centerline 50. The thrust plate 42 has an aperture 54 over the drive shaft bore 14 where the latter intersects the flat bottom of the counterbore and a planar side 56 facing and bearing against an end 58 of the cam ring. The pressure plate 44 has a planar side 60 facing and bearing against an end 62 of the cam ring and an annular shoulder 64 on which the cover 34 is seated. The oval-shaped wall 52 of the cam ring and the planar sides 56,60 of the thrust plate and the pressure plate cooperate in defining a generally oval-shaped rotor chamber 66, FIG. 6, in the rotating group.

The cover 34 compresses the rotating group against the flat bottom 18 of the counterbore to seal the rotor chamber 66 against fluid leakage between the planar side 56 of the thrust plate and the end 58 of the cam ring and between the planar side 60 of the pressure plate and the end 62 of the cam ring. A retaining ring 68 prevents dislodgment of the cover 34 from the cylindrical counterbore. A discharge chamber 70 of the vane pump is defined between the cover 34 and the pressure plate and within the housing 12 around the drive shaft bore 14. A seal ring 72 suppresses fluid leakage between the cover and the pressure plate.

A drive shaft 74 is supported on the pump housing for rotation about the longitudinal centerline 50. A splined inboard end of the drive shaft cooperates with a splined bore 76 in a rotor 78 in the rotor chamber 66 in coupling the shaft and rotor for unitary rotation about the longitudinal centerline 50. An outboard end, not shown, of the drive shaft is coupled to a source of motive power such as a motor of a motor vehicle when the vane pump 10 constitutes a source of pressurized fluid for a steering assist fluid motor on the motor vehicle.

The rotor 78 has a cylindrical outer surface 80 symmetric with respect to the longitudinal centerline 50 of the pump and a pair of planar end walls 82A,82B in planes perpendicular to the longitudinal centerline. The end walls 82A, 82B of the rotor are separated from the planar sides 60,56 of the pressure plate and the thrust plate by respective ones of a pair of clearance dimensions $D_1$,$D_2$, illustrated in exaggerated fashion in FIG. 6. The outer surface 80 of the rotor cooperates with the oval-shaped wall 52 of the cam ring in defining a pair of crescent-shaped cavities 84A,84B, FIG. 3, in the rotor chamber on opposite sides of the rotor.

A plurality of radial vane slots 86 in the rotor intersect the cylindrical outer surface 80 and each of the end walls 82A,82B of the rotor. A corresponding plurality of flat vanes 88 are supported in respective ones of the vane slots 86 for radial reciprocation. Each flat vane 88 has an outboard lateral edge 90, FIG. 1, bearing against the oval-shaped wall 52 of the cam ring and a pair of radial edges 92 separated from respective ones of the planar sides 60,56 of the pressure plate and the thrust plate by the clearance dimensions $D_1$,$D_2$. The vanes 88 divide the crescent-shaped cavities 84A,84B into a plurality of pump chambers 93 which expand in each of a pair of diagonally opposite inlet sectors of the crescent-shaped cavities and collapse in each of a pair of diagonally opposite discharge sectors of the crescent-shaped cavities in conventional fashion concurrent with rotation of the rotor.

The thrust plate 42 has a pair of diametrically opposite notches 94A,94B open to the annular chamber 36. The pressure plate 44 has a pair of diametrically opposite notches 96A,96B open to the annular chamber 36. The notches 94A,96A in the thrust plate and the pressure plate are angularly aligned with the inlet sector of the crescent-shaped cavity 84A and define a first inlet port of the vane pump. Similarly, the notches 94B,96B in the thrust plate and the pressure plate are angularly aligned with the inlet sector of the crescent-shaped cavity 84B and define a second inlet port of the vane pump.

The thrust plate 42 has a pair of diametrically opposite shallow grooves 98A,98B in the planar side 56 thereof. The pressure plate 44 has a pair of diametrically opposite shallow grooves 100A, 100B in the planar side 60 thereof. The shallow grooves 98A,100A in the thrust plate and the pressure plate are angularly aligned with the discharge sector of the crescent-shaped cavity 84A. The shallow grooves 98B,100B in the thrust plate and the pressure plate are angularly aligned with the discharge sector of the crescent-shaped cavity 84B. The shallow grooves 100A, 100B communicate with the discharge chamber 70 through a pair of schematically represented passages 102 in the pressure plate, FIG. 2, and define respective ones of a pair of discharge ports of the vane pump. The shallow grooves 98A,98B in the thrust plate communicate with the shallow grooves 100A,100B in the pressure plate through a pair of slots 104 molded in the cam ring. The discharge chamber 70 communicates with an external device such as the aforesaid steering assist fluid motor through a discharge passage, not shown, in the pump housing 12.

Figure 3:
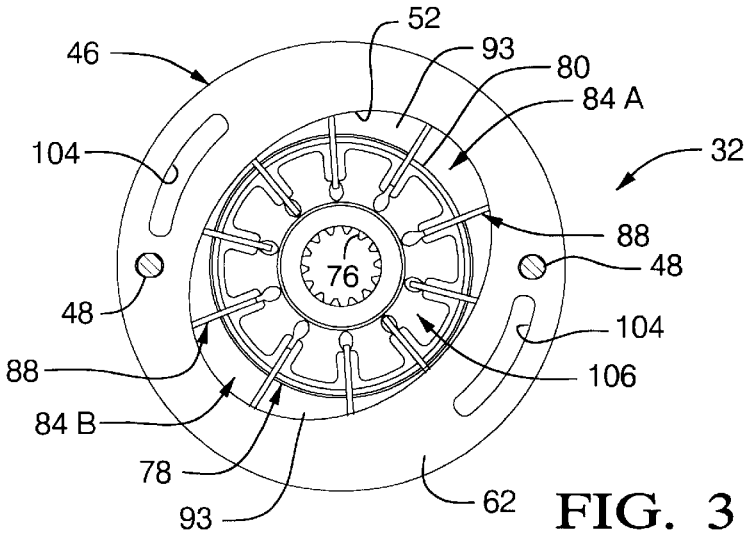
FIG. 3 is a sectional view taken generally along the plane indicated by lines 3—3 in FIG. 1.
Figure 4:
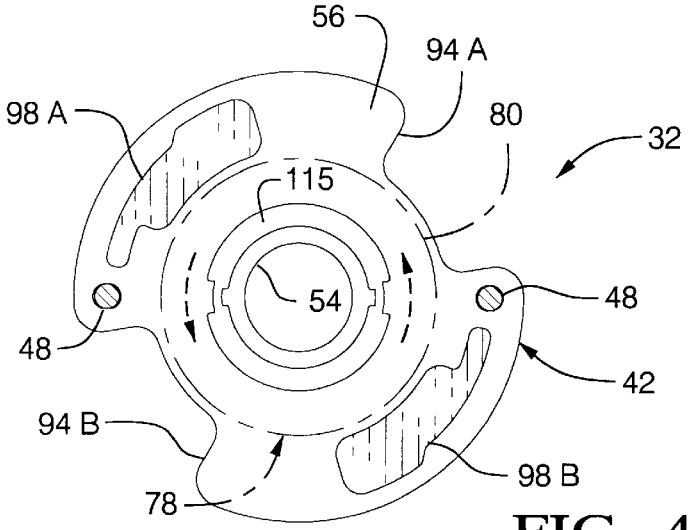
FIG. 4 is a sectional view taken generally along the plane indicated by lines 4—4 in FIG. 1.
Figure 5:
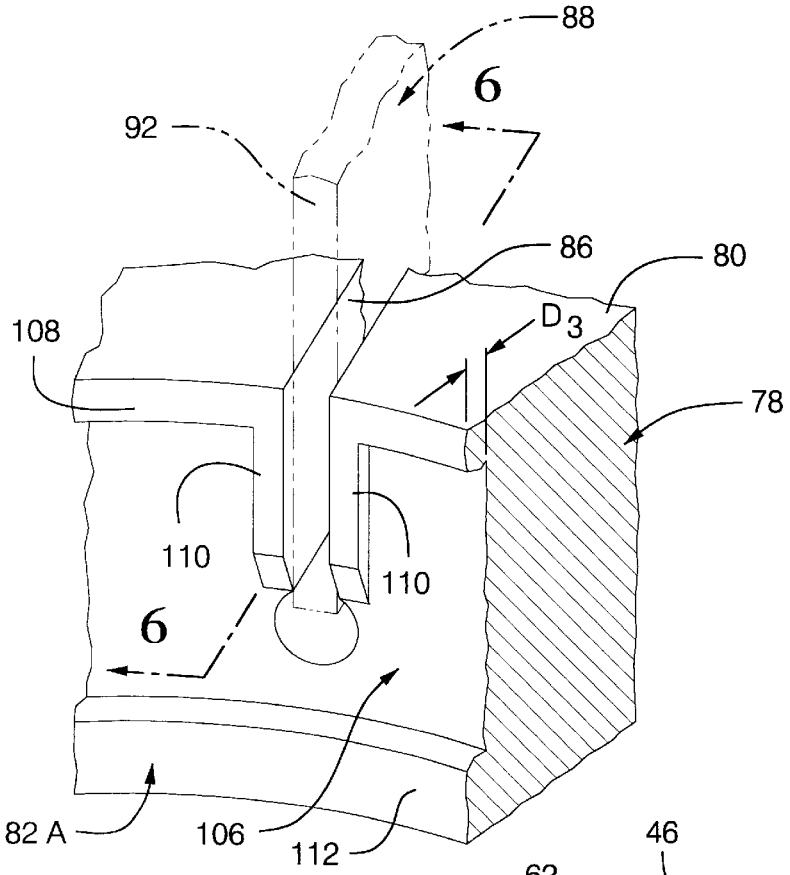
FIG. 5 is a fragmentary perspective view of a rotor of the vane pump according to this invention.
Figure 6:
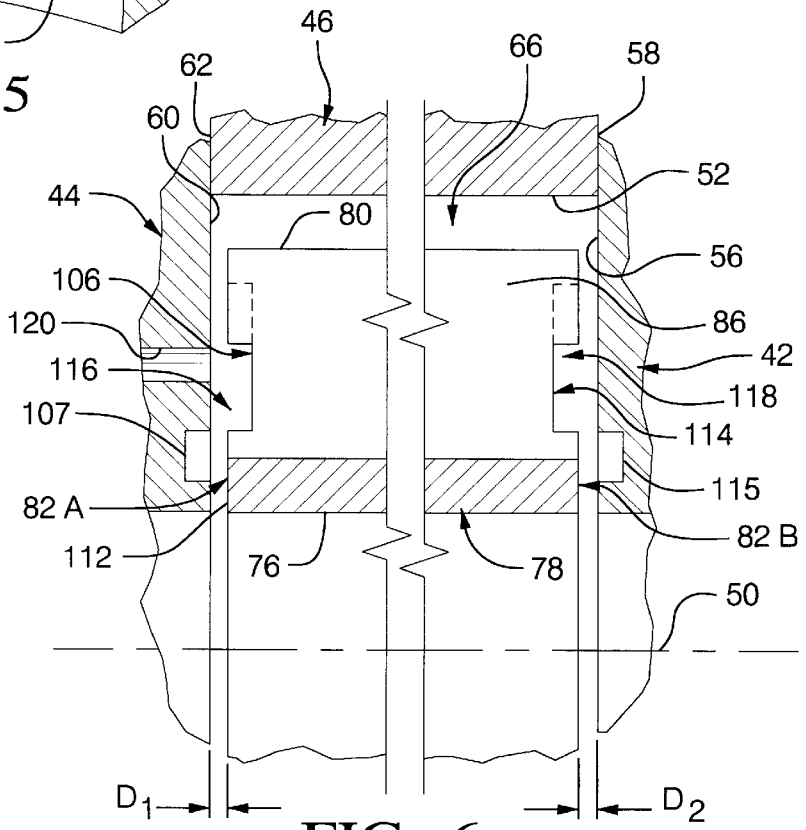
FIG. 6 is a fragmentary sectional view taken generally along the plane indicated by lines 6—6 in FIG. 5.

As seen best in FIGS. 3, 5 and 6, the planar end wall 82A of the rotor is interrupted by an annular groove 106 having a depth dimension $D_3$ of about 1.0 mm which intersects each of the radial vane slots 86 and faces a groove 107 in the planar side 60 of the pressure plate opposite the inboard ends of the vane slots 86. Radially outboard of the annular groove 106, the end wall 82A of the rotor defines an annular outer land 108 between the annular groove and the cylindrical outer surface 80 of the rotor. The annular outer land 108 is interrupted by each of the radial vane slots and turns toward the longitudinal centerline 50 on opposite sides of each vane slot to define a plurality of pairs of radial lands 110 integral with the outer land. Radially inboard of the annular groove 106, the end wall 82A of the rotor defines an annular inner land 112 between the annular groove 106 and the splined bore 76 in the rotor. The surface area of the annular groove 106 between the outer land 108 and the inner land 112 constitutes a reaction portion of the planar end wall 82A of the rotor having a surface area of at least 30% of the surface area of the planar end wall 82A.

The planar end wall 82B of the rotor is interrupted by an annular groove 114, FIG. 6, identical to the annular groove 106 in the end wall 82A facing a groove 115 in the planar side 56 of the thrust plate opposite the inboard ends of the vane slots 86. The surface area of the annular groove 114 between outer and inner lands corresponding to the outer and inner lands 108,112 constitutes a reaction portion of the planar end wall 82B of the rotor having a surface area of at least 30% of the surface area of the planar end wall 82B.

The groove 106 cooperates with the planar side 60 of the pressure plate in defining an annular first longitudinal balance chamber 116. The groove 114 cooperates with the planar side 56 of the thrust plate in defining an annular second longitudinal balance chamber 118. The first longitudinal balance chamber communicates with the discharge chamber 70 through a schematically represented passage 120 in the pressure plate. The second longitudinal balance chamber communicates with the first balance chamber 116 through the vane slots 86 under the vanes 88 therein.

The annular inner and outer lands 112,108 cooperate with the planar side 60 of the pressure plate in defining fluid seals on opposite sides of the annular groove 106 even though separated by the clearance dimension $D_1$. Likewise, the inner and the outer lands on opposite sides of the annular groove 114 in the end wall 82B of the rotor cooperate with the planar side 56 of the thrust plate in defining fluid seals on opposite sides of the annular groove 114 even though separated from the planar side 56 by the clearance dimension $D_2$. The close fit between the vanes 88 and the vane slots 86 suppresses fluid leakage from the balance chambers through the vane slots. The outer lands also separate the first and the second balance chambers from the aforesaid inlet and discharge ports of the vane pump.

Fluid at substantially atmospheric pressure is delivered to the annular chamber 36 around the rotating group 32 through the inlet passage 28, the aperture 30, and the internal passage 26 in the pump housing. As the drive shaft 74 rotates the rotor 78, the expanding pump chambers 93 in the inlet sectors of the crescent-shaped cavities 84A,84B are filled with fluid through the inlet ports defined by the notches 94A,96A and 94B,96B. The fluid in the pump chambers is transported by the rotor to the discharge sectors of the crescent-shaped cavities and expelled through the discharge ports defined by the shallow grooves 100A,100B into the discharge chamber 70.

The fluid pressure prevailing in the discharge chamber is a high discharge pressure of the vane pump. The discharge chamber is connected to the aforesaid steering assist fluid motor or similar device through a flow control valve, not shown, in the bore 24 in the pump housing. The flow control valve maintains a substantially constant rate of fluid flow from the vane pump by recirculating a fraction of the fluid expelled from the pump chambers 93 back to the annular chamber 36 around the rotating group through the internal passage 26 in the pump housing.

The fluid in the discharge chamber induces a net pressure force on the pressure plate 44 represented by a schematic force vector $F_1$, FIG. 1, which reacts evenly across the exposed area of the pressure plate. The net pressure force represented by the schematic vector $F_1$ thrusts the rotating group against the flat bottom 18 of the counterbore 20 for enhanced suppression of fluid leakage from between the planar side of the thrust plate and the end 58 of the cam ring and between the planar side of the pressure plate and the end 62 of the cam ring.

At the same time, fluid at the discharge pressure of the pump is conducted or ported to the annular first balance chamber 116 through the passages 102 and 120 in the pressure plate and from the first balance chamber into the second balance chamber 118 through the vane slots 86 under of the flat vanes 88. The fluid pressure under the flat vanes thrusts the outboard lateral edges 90 of the vanes against the oval-shaped wall 52 of the cam ring to suppress fluid leakage from the pump chambers 93 between the vanes and the oval-shaped wall.

The fluid pressure in the first balance chamber 116 induces a net pressure force on the pressure plate represented by a schematic force vector $F_2$ opposite to the net pressure force represented by the schematic vector $F_1$ The fraction of the net pressure force represented by the schematic vector $F_1$ reacting on the pressure plate within the silhouette of the oval-shaped rotor chamber 66 is effectively offset or balanced by the net pressure force represented by the schematic vector $F_2$ because the reaction portion of the planar end wall 82A of the rotor constitutes a substantial fraction of the area of the silhouette of the rotor chamber 66. Accordingly, the flexure of the pressure plate 44 into the rotor chamber characteristic of the prior vane pumps referred to above is substantially reduced so that the clearance dimension $D_1$ is smaller than corresponding clearance dimensions in such prior vane pumps for improved volumetric efficiency.

The fluid pressure in the first balance chamber 116 also reacts against the reaction portion of the planar end wall 82A of the rotor and thrusts the rotor toward thrust plate. Concurrently, however, the same fluid pressure in the annular second balance chamber 118 reacts against the reaction portion of the opposite end wall 82B of the rotor and thrusts the rotor toward the pressure plate. Because the reaction portions of the planar first and second end walls of the rotor are equal, the net pressure force on the rotor attributable to fluid in the annular first balance chamber equals the net pressure force on the rotor attributable to fluid in the annular second balance chamber. Accordingly, the rotor is suspended longitudinally in static equilibrium between the planar sides of the pressure plate and the thrust plate with the substantially equal clearance dimensions $D_1$, $D_2$ minimizing both sliding friction and fluid leakage between the rotor and the flat vanes thereon and the planar sides of the thrust plate and the pressure plate.

Having thus described the invention, what is claimed is:

1. In a vane pump including a housing, a discharge pressure chamber in said housing having a fluid therein at a discharge pressure of said vane pump, a rotating group including a thrust plate seated on said housing and a pressure plate exposed to said discharge chamber and a cam ring clamped between said pressure plate and said thrust plate by a fluid pressure force on said pressure plate attributable to said fluid in said discharge chamber, an oval-shaped wall on said cam ring cooperating with a planar side of said pressure plate and with a planar side of said thrust plate in defining a rotor chamber in said rotating group, a rotor supported in said rotor chamber for rotation about a longitudinal centerline of said vane pump perpendicular to said planar side of said thrust plate and to said planar side of said pressure plate, a plurality of radial vane slots in said rotor each intersecting a first planar end wall of said rotor facing said planar side of said pressure plate and a second planar end wall of said rotor facing said planar side of said thrust plate and an outer cylindrical surface of said rotor facing said oval-shaped wall on said cam ring, and a plurality of flat vanes slidable in said respective ones of said vane slots, the improvement comprising:

a first chamber-forming means operative to define a first longitudinal balance chamber exposed to a reaction portion of said first planar end wall of said rotor constituting at least 30% of the area of said first planar end wall and to said planar side of said pressure plate, a second chamber-forming means operative to define a second longitudinal balance chamber exposed to said planar side of said thrust plate and to a reaction portion of said second planar end wall of said rotor equal to said reaction portion of said first planar end wall of said rotor, a first port means operative to port fluid at said discharge pressure of said vane pump to said first balance chamber thereby to balance a fraction of said pressure force on said pressure plate attributable to said fluid in said discharge chamber, and a second port means operative to port fluid at said discharge pressure of said vane pump to said second balance chamber thereby to maintain said rotor in static equilibrium in the direction of said longitudinal centerline of said vane pump.

2. The vane pump recited in claim 1 wherein said first chamber-forming means comprises:

an annular groove in said first planar end wall of said rotor intersecting each of said radial vane slots and separated from said cylindrical outer surface of said rotor by an annular outer land interrupted by each of said radial vane slots and from a bore in the middle of said rotor by an annular inner land radially inboard of each of said radial vane slots.

3. The vane pump recited in claim 2 wherein said second chamber-forming means comprises:

an annular groove in said second planar end wall of said rotor intersecting each of said radial vane slots and separated from said cylindrical outer surface of said rotor by an annular outer land interrupted by each of said radial vane slots and from said bore in the middle of said rotor by an annular inner land radially inboard of each of said radial vane slots.

4. The vane pump recited in claim 3 wherein said first port means operative to port fluid at said discharge pressure of said vane pump to said first balance chamber comprises:

a passage in said pressure plate exposed at a first end to said discharge chamber of said vane pump and at a second end to said first balance chamber.

5. The vane pump recited in claim 4 wherein said second port means operative to port fluid at said discharge pressure of said vane pump to said second balance chamber comprises:

a plurality of under-vane passages in said rotor defined between said plurality of vanes and an inboard end of corresponding ones of said plurality of vane slots in said rotor each exposed at a first end thereof to said first balance chamber and at a second end thereof to said second balance chamber.

* * * * *